US008360801B2

(12) United States Patent
Lynch et al.

(10) Patent No.: US 8,360,801 B2
(45) Date of Patent: Jan. 29, 2013

(54) CONTACTLESS PLUG DETECT MECHANISM

(75) Inventors: Stephen Brian Lynch, Portola Valley, CA (US); Fletcher Rothkopf, Mountain View, CA (US); Gordon Cameron, Ottawa (CA)

(73) Assignee: Apple Inc., Cupertino, CA (US)

( * ) Notice: Subject to any disclaimer, the term of this patent is extended or adjusted under 35 U.S.C. 154(b) by 1013 days.

(21) Appl. No.: 12/356,567

(22) Filed: Jan. 21, 2009

(65) Prior Publication Data

US 2010/0182159 A1 Jul. 22, 2010

(51) Int. Cl.
*H01R 3/00* (2006.01)

(52) U.S. Cl. ..... 439/488

(58) Field of Classification Search ..... 439/668–669, 439/488, 489, 188, 676, 660; 200/51.09, 200/51.11

See application file for complete search history.

(56) References Cited

U.S. PATENT DOCUMENTS

| | | | | |
|---|---|---|---|---|
| 5,186,639 | A | 2/1993 | Comerci et al. | |
| 6,321,278 | B1 | 11/2001 | Phu et al. | |
| 6,332,803 | B1 | 12/2001 | Matsuda et al. | |
| 6,662,119 | B1 | 12/2003 | Mitchell | |
| 6,835,080 | B1 | 12/2004 | Chang | |
| 6,837,733 | B2 | 1/2005 | Katsuma | |
| 6,890,197 | B2 | 5/2005 | Liebenow | |
| 6,971,907 | B1 | 12/2005 | Stroud | |
| 7,094,087 | B2 * | 8/2006 | Larn | 439/188 |
| 7,326,088 | B2 | 2/2008 | Tulkki | |
| 7,635,280 | B1 * | 12/2009 | Crumlin et al. | 439/489 |
| 2006/0233413 | A1 | 10/2006 | Nam | |
| 2007/0086273 | A1 | 4/2007 | Polany et al. | |
| 2007/0104332 | A1 | 5/2007 | Clemens et al. | |
| 2008/0160810 | A1 | 7/2008 | Ferguson et al. | |
| 2008/0188122 | A1 | 8/2008 | Edeler et al. | |
| 2008/0247592 | A1 * | 10/2008 | Kourzanov | 381/384 |
| 2009/0107827 | A1 * | 4/2009 | Hansson et al. | 200/571 |
| 2009/0253274 | A1 * | 10/2009 | Fendrock et al. | 439/38 |

FOREIGN PATENT DOCUMENTS

| | | |
|---|---|---|
| WO | WO0041275 | 7/2000 |
| WO | WO2004054037 | 6/2004 |
| WO | WO2006045617 | 5/2006 |
| WO | WO2007044463 | 4/2007 |

OTHER PUBLICATIONS

"Using Comparators to Detect Accessories in Portable Audio Applications," Arpit Mehta, Maxim Integrated Products, Nov. 5, 2008, pp. 7.

* cited by examiner

*Primary Examiner* — Edwin A. Leon
(74) *Attorney, Agent, or Firm* — Dorsey & Whitney LLP

(57) ABSTRACT

This is directed to systems and methods for detecting the insertion of a plug in a device port without physically contacting the plug. For example, systems and methods are provided for detecting the insertion of an audio plug into an audio jack without using physical contacts placed in the periphery of the audio jack. In some embodiments, an electrically conductive element (e.g., a circuit board trace) can be provided on a surface of the port or within the port wall. When a metallic or conductive plug is inserted into the port, the plug can interact with the conductive element and cause a change in capacitance or induction detected by appropriate circuitry coupled to the conductive element. In some embodiments, an optical sensor can be used to detect a plug placed in a port. In some embodiments, the electronic device can detect distinguishable attributes associated with the contact between the electrical contact of plug and port contacts using an appropriate sensor (e.g., a microphone or an accelerometer).

17 Claims, 2 Drawing Sheets

CONTACTLESS PLUG DETECT MECHANISM

BACKGROUND OF THE INVENTION

This is directed to detecting a plug placed in an electronic device without physically contacting the plug.

Many electronic devices provide functionality via accessories coupled to the electronic devices using a plug. For example, media players can include a jack into which an audio plug can be inserted to provide audio from the device to a speaker or headphone connected to the jack. As another example, laptop and desktop computers can include USB ports for receiving USB accessories such as input mechanisms (e.g., a keyboard and mouse), peripheral devices (e.g., a printer), storage media (e.g., external hard or solid state drives), or any other suitable accessory providing additional functionality to the device.

To provide the additional functionality, an electronic device may first detect the accessory device plug inserted into an appropriate aperture of the device and enable a state associated with the detected accessory device. One typical manner to detect a plug is to provide spring arms or other components in the device aperture that are placed in physical contact with the plug upon insertion of the plug. For example, an audio jack can include two or more conductive spring arms operative to create an electrically conductive connection with an inserted plug. A circuit can then detect that the two or more conductive spring arms have been shorted to determine that a plug was inserted in the device.

As the size of devices is reduced, however, space may not be available to provide spring arms or components for physically contacting a plug. Alternatively, the spring arms or components can limit the overall size of the electronic device. In addition, the physical contact of between the spring arms or other components and the plug can be a source of failure (e.g., fatigue failure after a particular number of plug insertion-removal cycles).

SUMMARY OF THE INVENTION

This is directed to systems and methods for detecting a plug without physically contacting the plug.

A plug can be inserted in a jack or other port to provide enhanced functionality to the electronic device. As the device manages its operations and resources, it may selectively enable particular functions associated with different ports based on the type or number of connected peripheral devices. For example, a media playback device can be in a first state in which media playback is enabled when an audio plug is detected in a jack, and in a second state in which media playback is prevented when no audio plug is detected in the jack. This may require the electronic device to first determine when a plug is inserted in a device port.

The electronic device can use any suitable approach for detecting a plug in a port without physically contacting the plug. In some embodiments, one or more of a capacitance sensor and an inductive sensor can be used to detect a plug. For example, an electronic device can include a capacitive trace placed within a port wall or adjacent to a port wall. As a plug is inserted in the port, the capacitance detected from the capacitive trace can change to indicate the presence of a conductive material near the trace. As another example, an electronic device can include an inductive trace placed within a port wall or adjacent to a port wall. When a conductive plug (e.g., a metallic audio plug) is placed in the port, the inductance detected from the inductive trace can change, indicating the presence of conductive material within the plug. The size and location of the capacitive or inductive traces can be selected based on the precision of the detector, the amount of plug material inserted adjacent to the trace within the port, or any other suitable criteria.

In some embodiments, the electronic device can instead or in addition use an optical sensing mechanism to detect the presence of a plug in a port. For example, the port wall can include one or more apertures through which an emitter can emit radiation that reflects off of the plug and back to a detector, which detects the reflected radiation. In some cases, the detector can be operative to identify particular radiation reflected from the plug. For example, the detector can be operative to identify a particular wavelength radiation (e.g., light waves reflected in particular manner off a polished plug (e.g., an audio plug).

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION

Figure 1:
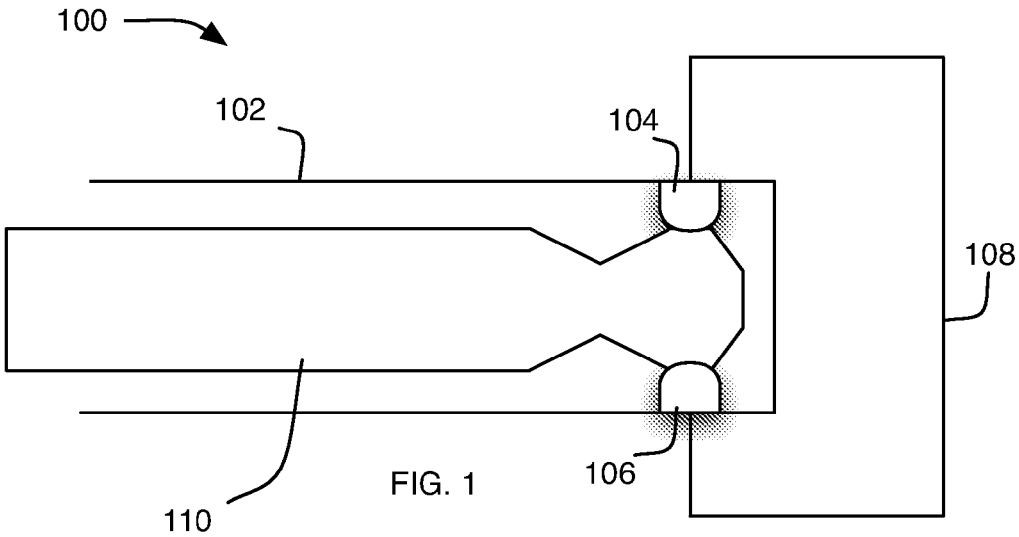
FIG. 1 is a cross-sectional view of an illustrative audio plug placed in an audio jack and detected using contacts.

In some devices, an audio plug is detected in an audio jack using spring arms or contacts that come into contact with a portion of the audio plug. FIG. 1 is a cross-sectional view of an illustrative audio plug placed in an audio jack and detected using contacts. Device 100 can include jack 102 operative to receive plug 110. Jack 102 can include arms 104 and 106 placed on opposite sides of jack 102 such that a portion of plug 110 contacts both arms 104 and 106 when plug 110 is inserted in jack 102. Circuit 108 can couple arms 104 and 106 such that circuit 108 is closed when plug 110 connects arms 104 and 106. When circuit 108 detects that it is closed, the electronic device can enable communications with a peripheral device of plug 110 (e.g., change the state of the device). This approach, however, requires a physical and electrically conductive contact between plug 110 and both arms 104 and 106.

Figure 2:
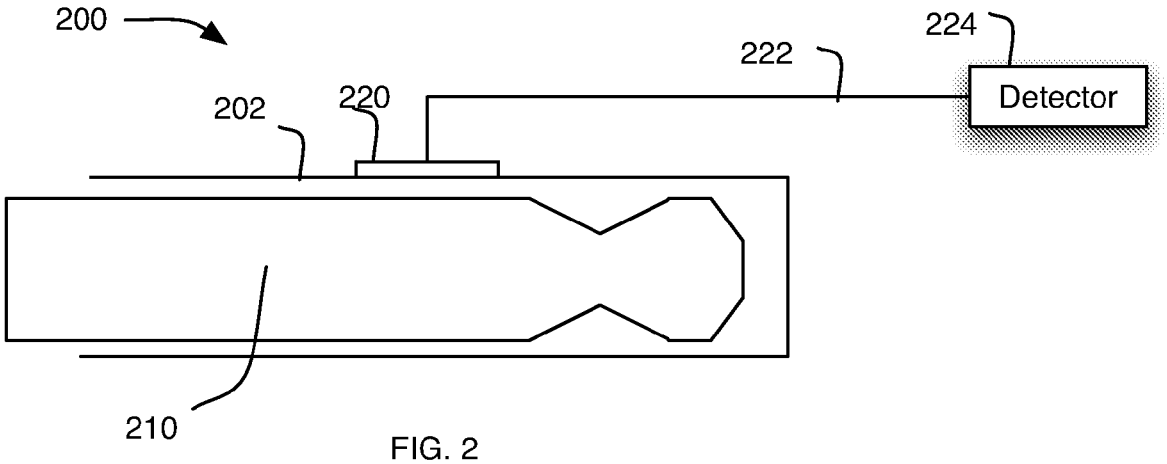
FIG. 2 is a cross-sectional view of an illustrative plug placed in a port and detected using a capacitive sensor in accordance with one embodiment of the invention.

To remove the space required by arms 104 and 106, other approaches can be used to detect a plug. FIG. 2 is a cross-sectional view of an illustrative plug placed in a port and detected using a capacitive sensor in accordance with one embodiment of the invention. Device 200 can include port 202 operative to receive plug 210 (e.g., in a port receptacle). To detect the insertion or removal of plug 210, port 202 can include at least one conductive element 220 deposited on the exposed surface of port 202 to form a capacitive sensor. As plug 210 moves past element 220 when it is inserted in port 202, the capacitance of element 220 can change. Detector 224, which can be coupled to element 220 via path 222, can detect the change in capacitance, and provide an indication to a processor. In some embodiments, conductive element 220 can be positioned within the wall of port 202 (e.g., not exposed to plug 210), or on or adjacent to the hidden surface of the port wall. For example, conductive element 220 can include a conductive trace in a circuit board located adjacent to the port wall. In response to the output of detector 224, a processor of the electronic device can change the state or mode of the device.

Conductive element 220 can be positioned along any suitable portion of port 202. For example, conductive element 220 can be positioned near the opening of port 202, or near the closed end of port 202 (e.g., near the inner-most portion of port 202 that plug 210 can reach). As another example, several conductive elements 220 can be distributed along the surface of port 202. By placing a conductive element 220 near the inner-most portion of port 202, detector 224 may be able to detect plug 210 only when it is fully inserted in port 202, and thus reduce user frustration due to improper detection of an incompletely inserted plug. Alternatively, the electronic device can provide different functionality based on how deep the plug is inserted in the port (e.g., the processor can provide no microphone support for partially inserted audio plugs). If several conductive elements 220 are provided along the length of port 202, detector 224 may be operative to identify the particular elements 220 opposite which plug 210 is positioned, and monitor the detected change in adjacent elements to determine whether a plug is being inserted or removed from port 202.

Figure 3:
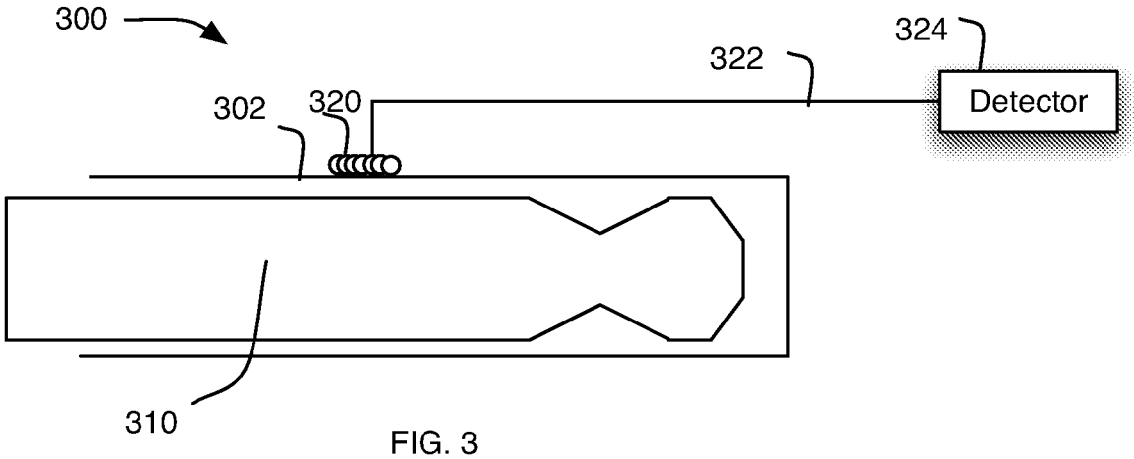
FIG. 3 a cross-sectional view of an illustrative plug placed in a port and detected using an inductive sensor in accordance with one embodiment of the invention.

FIG. 3 a cross-sectional view of an illustrative plug placed in a port and detected using an inductive sensor in accordance with one embodiment of the invention. Device 300 can include port 302 operative to receive plug 310. To detect the insertion or removal of plug 310, port 302 can include at least one inductive element 320 deposited on the exposed surface of port 302 to form an inductive sensor. Inductive element 320 can include any suitable wire, coil, or other conductive component forming a circuit. As plug 310 moves past element 320 when it is inserted in port 302, the inductance of a circuit including inductive element 320 can change. Detector 324, which can be coupled to element 320 via path 322, can then detect the change in inductance. In some embodiments, inductive element 320 can be positioned within the wall of port 302 (e.g., not exposed to plug 310), or on or adjacent to the hidden surface of the port wall. For example, conductive element 320 can include a conductive trace in a circuit board located adjacent to the port wall (e.g., a trace forming a loop adjacent to the port wall). The size or orientation of conductive element 320 can be selected based on any suitable criteria, including for example the size of the plug inserted in port 302, the amount or density of conductive material in the plug, and the precision of detector 324.

Inductive element 320 can be positioned along any suitable portion of port 302. For example, inductive element 320 can be positioned near the opening of port 302, or near the closed tip of port 302 (e.g., near the inner-most portion of port 302 that plug 310 can reach). As another example, several inductive elements 320 can be distributed along the surface of port 302. By placing an inductive element 320 near the distal-most portion of port 302 (i.e., the portion of port 302 that is furthest from the plug opening), detector 324 may be able to detect plug 310 only when it is fully inserted in port 302, and thus reduce user frustration due to an improperly inserted plug. Alternatively, the electronic device can provide different levels of functionality based on how deep the plug is inserted in the port (e.g., no microphone support for partially inserted audio plugs). If several inductive elements 320 are distributed along the length of port 302, detector 324 may be operative to identify the particular elements 320 opposite which plug 310 is positioned, and monitor the detected change in adjacent elements to determine whether a plug is being inserted or removed from port 302.

Figure 4:
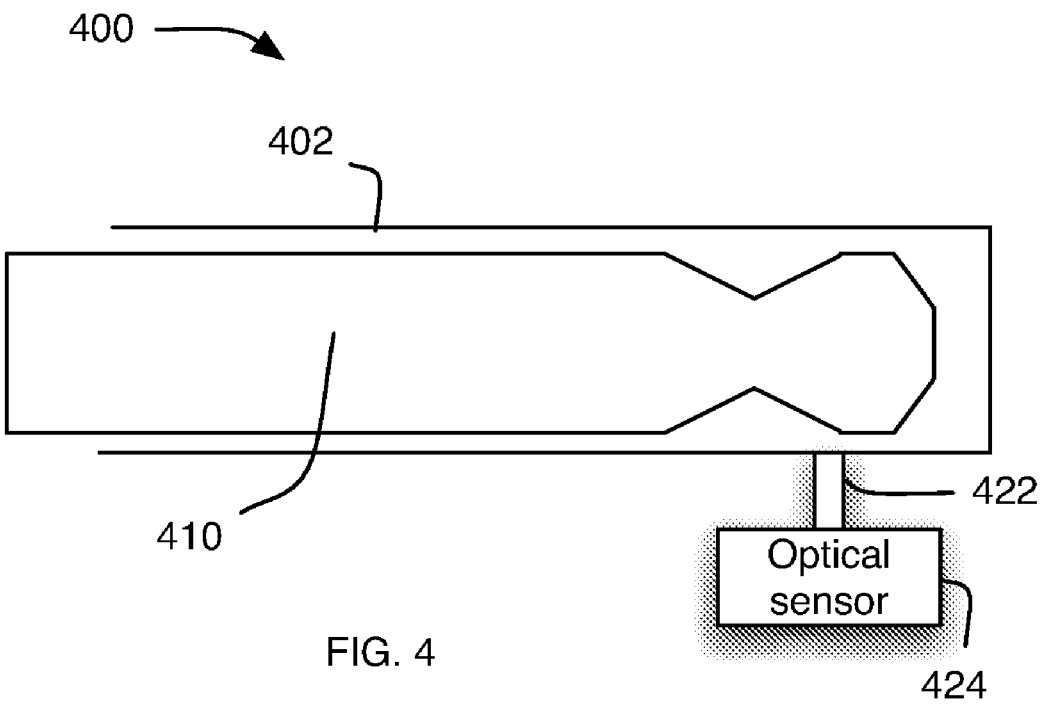
FIG. 4 is a cross-sectional view of an illustrative plug placed in a port and detected using an optical sensor in accordance with one embodiment of the invention.

FIG. 4 is a cross-sectional view of an illustrative plug placed in a port and detected using an optical sensor in accordance with one embodiment of the invention. Device 400 can include port 402 operative to receive plug 410. To detect the insertion or removal of plug 410, port 402 can include at least one optical path 422 providing a conduit between optical sensor 424 and the inside of port 402. Optical path 422 can include any suitable connecting mechanism allowing light waves or other radio waves to be directed between port 402 and optical sensor 424, such as a light tube, a fiber optic cable, an aperture (e.g., a hollow tube), or any other connecting mechanism or conduit. Optical sensor 424 can include one or both of an emitter for emitting radio waves at a particular frequency (e.g., a light emitting diode emitting light waves at a particular frequency or frequency range) and a detector for detecting light waves reflected from a surface (e.g., from plug 410). As plug 410 moves past optical path 422, radiation emitted by optical sensor 424 can travel along optical path 422, reflect off of plug 410, and travel back through optical path 422 to optical sensor 424 for detection. The optical properties of plug 410 and the inner surface of port 402 can be different such that the radiation reflected back to optical sensor 424 changes in a measurable manner when plug 410 is inserted in port 402. For example, plug 410 can be polished, while the inner surface of port 402 can be non-reflective, such that the amount of radiation reflected by plug 410 is larger than the amount of radiation reflected by the inner surface of port 402 (e.g., when no plug is present). As another example, the shapes of plug 410 and of the inner surface of port 402 can reflect radiation in different manners (e.g., one diffuses more radiation than the other, or one reflects radiation away from optical path 422), such that a measurable difference in reflected radiation can be detected.

Optical path 422 can be positioned along any suitable portion of port 402. For example, optical path 422 can be positioned near the opening of port 402, or near the closed tip of port 402 (e.g., near the inner-most portion of port 402 that plug 410 can reach). As another example, several optical paths 422 can be distributed along the surface of port 402. By placing an optical path 422 near the distal-most portion of port 402 (i.e., the portion of port 402 that is furthest from the plug opening), optical sensor 424 may be able to detect plug 410 only when it is fully inserted in port 402, and thus reduce user frustration due to an improperly inserted plug. Alternatively, the electronic device can provide different functionality based on how deep the plug is inserted in the port (e.g., no microphone support for partially inserted audio plugs). If several optical paths 422 are provided, detector 424 may be operative to identify the particular elements 420 opposite which plug 410 is positioned, and monitor the detected change in adjacent elements to determine whether a plug is being inserted or removed from port 402.

In some embodiments, the electronic device can detect the insertion or removal of a plug in a port using sensors that are not directly connected or related to the plug, but have other primary uses in the electronic device. In particular, the electronic device can include one or more sensors operative to detect particular attributes of the plug insertion or removal process (e.g., detect events caused by the plug insertion or removal). For example, a plug can include several contact regions operative to contact corresponding port regions and form electrically conductive paths between the plug and the port. Using the electrically conductive paths, the electronic device and accessory device associated with plug can transfer data or power in the course of the operation of each device. As the contact regions of the plug come into physical contact with the corresponding port regions, one or more detectable events can occur. For example, the physical contact between contact regions of the plug and port can generate a distinguishable vibration or motion detectable by an accelerometer of the device. As another example, the physical contact can generate one or more audible and distinguishable sounds or sequence of sounds detectable by a microphone of the electronic device.

Figure 5:
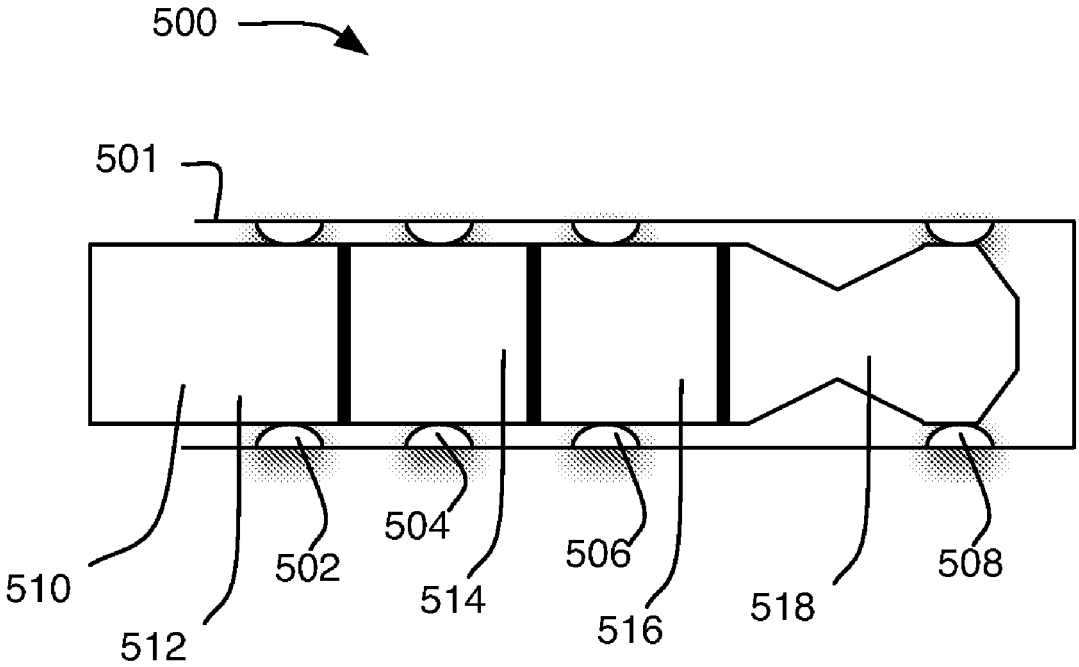
FIG. 5 is a schematic view of an audio plug inserted into an audio jack in accordance with one embodiment of the invention.

The following example will serve to illustrate the detection of a plug using an accelerometer or a microphone in the context of an audio plug inserted into an audio jack. FIG. 5 is a schematic view of an audio plug inserted into an audio jack in accordance with one embodiment of the invention. Device 500 can include audio jack 501 operative to receive audio plug 510. To provide data from the electronic device to the speakers coupled to audio plug 510, audio jack 501 can include several contacts 502, 504, 506 and 508 operative to contact corresponding portions of audio plug 510. Contacts 502, 504, 506 and 508 can be biased away from the surface of jack 501 to ensure that each of the contacts is placed in contact and remains in contact with plug 510 when it is inserted in the jack. In particular, each of the contacts can be positioned such that it is elastically deformed when plug 510 is inserted in the jack and thus retained against plug 510.

Plug 510 can include several conductive regions 512, 514, 516 and 518, each operative to conduct different signals (e.g., left audio, right audio, ground, and microphone signals). Each of contacts 502, 504, 506, and 508 can be associated with a particular corresponding conductive region of plug 510 (e.g., contact 502 with region 512, contact 504 with region 514, contact 506 with region 516, and contact 508 with region 518). When plug 510 is initially introduced into jack 501, region 518 may first come into contact with contacts 502, 504, and 506 before finally reaching contact 508 (e.g. due to the biasing of the contacts). Similarly, regions 514 and 516 can come into contact with other contacts of plug 510 than the one with which the region is associated. The succession of impacts between contacts and jack regions with which the contacts are not associated can define a sufficiently unique or distinguishable sequence of vibrations or sounds that an accelerometer or microphone, respectively, can detect and identify. Alternatively, a single, particular contact between a contact region and a contact (e.g., contact region 516 and contact 504, or contact region 516 and associated contact 506) can be sufficiently unique or distinguishable for the device to detect the insertion of audio plug 510 in audio jack 501.

The above-described embodiments of the present invention are presented for purposes of illustration and not of limitation, and the present invention is limited only by the claims which follow.

What is claimed is:

1. An electronic device port operative to receive a plug, comprising:

a receptacle for receiving the plug, the receptacle comprising a wall operative to surround the plug when the plug is inserted in the structure;

a conductive element positioned adjacent to the wall, wherein the conductive element does not come into physical contact with the plug when the plug is inserted into the receptacle; and a detector coupled to the conductive element, the detector operative to detect a change in an electrical property of the conductive element, wherein the electrical property of the conductive element change in the presence of the plug;

wherein the electronic device comprises a conductive trace positioned adjacent to a surface of the wall not exposed to the plug and the conductive trace is incorporated on a printed circuit board positioned adjacent to the receptacle.

2. The electronic device port of claim 1, wherein: the detector is operative to detect a change in capacitance associated with the conductive element.

3. The electronic device port of claim 1, wherein: the detector is operative to detect a change in inductance associated with the conductive element.

4. The electronic device port of claim 1, wherein the conductive element is positioned on the surface of the wall exposed to the plug, such that the plug does not come into contact with the conductive element.

5. The electronic device port of claim 1, wherein the conductive element is positioned within the thickness of the wall.

6. The electronic device port of claim 1, wherein the conductive trace comprises at least one loop.

7. The electronic device port of claim 1, further comprising: an optical sensor positioned adjacent to the receptacle, wherein the optical sensor is operative to emit radiation into and receive radiation reflected from the receptacle.

8. The electronic device port of claim 7, wherein the reflected radiation detected by the optical sensor changes based on the presence or absence of the plug within the receptacle.

9. The electronic device port of claim 1, wherein the port comprises an audio jack.

10. An electronic device operative to detect the insertion of a plug in a device port, comprising:

at least one port operative to receive a plug, the port comprising at least one contact operative to physically contact the plug to provide an electrical connection between the plug and the electronic device, the at least one port comprising a receptacle operative to receive the plug, the receptacle comprising a wall operative to surround the plug when the plug is inserted into the port;

a sensor operative to detect an event associated with the physical contact of the port contact and the plug;

a conductive trace positioned adjacent to a surface of the wall not exposed to the plug and the conductive trace is incorporated on a printed circuit board positioned adjacent to the receptacle; and a processor operative to enable an electronic device operation in response to the sensor detecting the event.

11. The electronic device of claim 10, wherein the sensor is further operative to detect a vibration event associated with the physical contact.

12. The electronic device of claim 10, wherein the sensor is further operative to detect an audible event associated with the physical contact.

13. The electronic device of claim 10, wherein the processor is further operative to change the state of the electronic device.

14. The electronic device of claim 13, wherein the processor is further operative to change the state of the electronic device between a first state in which media playback is enabled and a second state in which media playback is disabled.

15. A method for detecting a plug inserted in an electronic device port, comprising:

providing an electronic device having a port for receiving a plug, the electronic device comprising at least one conductive element positioned adjacent to the port such that the plug is not in contact with the conductive element when the plug is inserted in the port, the port comprising a receptacle operative to receive the plug, the receptacle comprising a wall operative to surround the plug when the plug is inserted into the port, wherein the electronic device comprises a conductive trace positioned adjacent to a surface of the wall not exposed to the plug and the conductive trace is incorporated on a printed circuit board positioned adjacent to the receptacle;

detecting a change in an electrical property of the conductive element, wherein the change indicates the presence or absence of the plug in the port; and changing the state of the electronic device in response to detecting.

16. The method of the claim 15, wherein detecting further comprises detecting a change in capacitance associated with the at least one conductive element.

17. The method of the claim 15, wherein detecting further comprises detecting a change in inductance associated with the at least one conductive element.

* * * * *